United States Patent [19]

Devienne

[11] 4,145,629

[45] Mar. 20, 1979

[54] SOURCE OF IONS OF HIGH MASS, ESPECIALLY IONS OF URANIUM OXIDE $UO_2$

[76] Inventor: Fernand M. Devienne, 117 La Croisett, 06400 Cannes, France

[21] Appl. No.: 707,319

[22] Filed: Jul. 21, 1976

[30] Foreign Application Priority Data

Jul. 25, 1975 [FR] France ..... 75 23353
Dec. 18, 1975 [FR] France ..... 75 38913

[51] Int. Cl.[2] ..... H01J 27/00
[52] U.S. Cl. ..... 313/230; 313/231.3
[58] Field of Search ..... 313/230, 231, 231.3, 313/362, 363

[56] References Cited

FOREIGN PATENT DOCUMENTS 2212044 7/1974 France.

*Primary Examiner*—Rudolph V. Rolinec
*Assistant Examiner*—Darwin R. Hostetter
*Attorney, Agent, or Firm*—Flynn & Frishauf

[57] ABSTRACT

An evacuated chamber contains a source of primary ions, a charge-exchange box, the inlet of which is supplied by the primary ion source and delivers at the outlet a primary molecular or atomic beam which is at least partially neutralized, a target of the material to be ionized which intercepts the emergent primary beam from the charge-exchange box and which is of such geometry that the primary beam undergoes multiple reflections from the target, the target being placed within a chamber which is brought to a potential opposite to that of the polarity of the ions produced.

14 Claims, 4 Drawing Figures

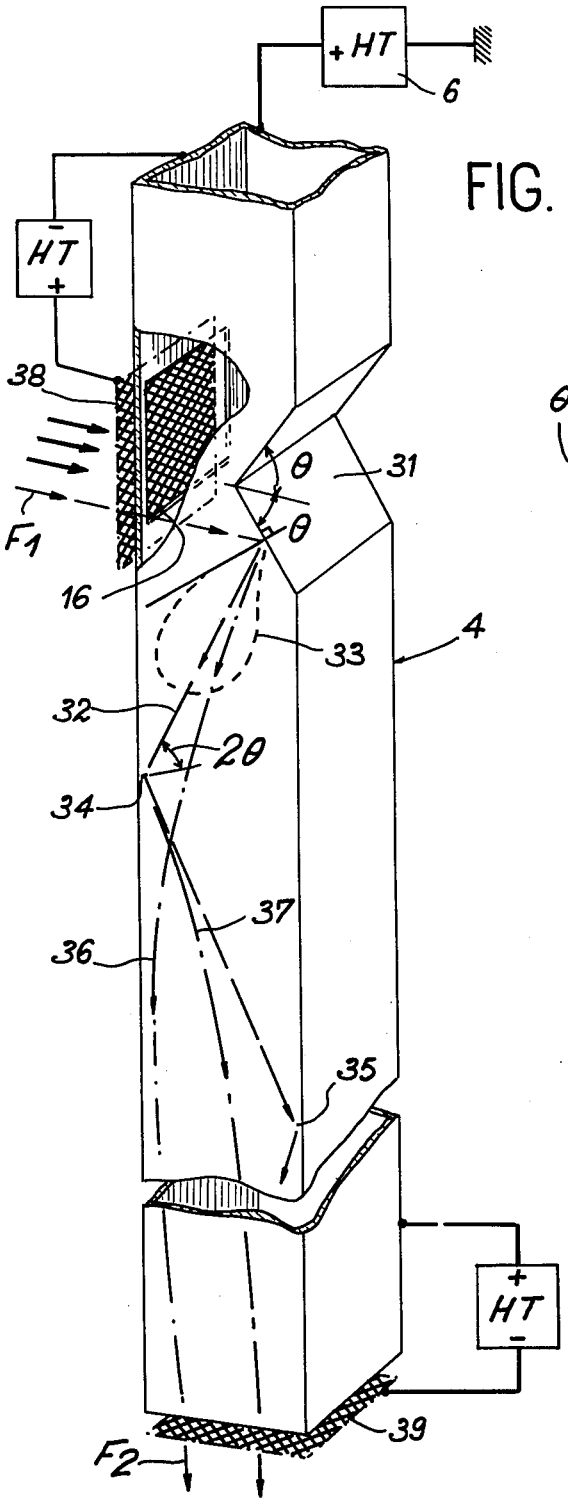
FIG. 2
FIG. 3
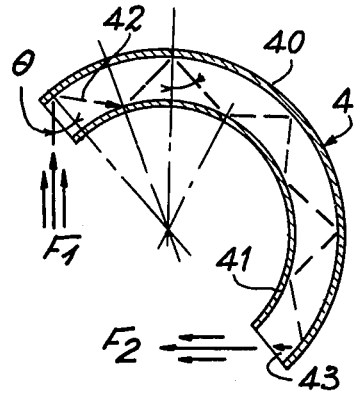
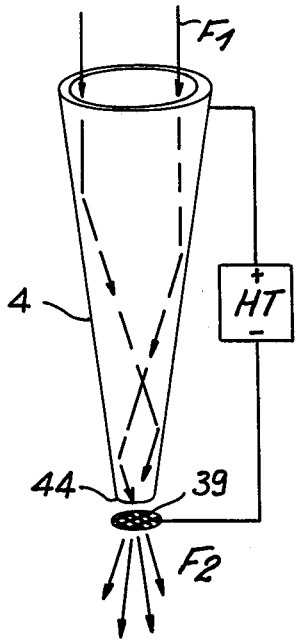
FIG. 4

SOURCE OF IONS OF HIGH MASS, ESPECIALLY IONS OF URANIUM OXIDE $UO_2$

This invention relates to a source of ions of high mass, especially ions of uranium oxide $UO_2$.

As is already known, it is necessary in many applications to produce ion sources of high intensity, these ions being of high mass such as, for example, the ions containing uranium, among others the uranium oxide $UO_2$. In fact, these ion sources containing uranium can be put to use, provided that they are of sufficient intensity, in isotope separation processes in which the separation is carried out from uranium in the state of an ionic compound.

As will hereinafter become apparent, the ion source in accordance with the invention makes it possible to obtain ion beams of high mass and of relatively high current density of the order of several $mA/cm^2$.

The ion source in accordance with the invention comprises a source of primary ions, for example argon ions formed by any suitable means such as high-frequency heating, a charge-exchange box, the inlet of which is fed by said source of primary ions, said box being intended to deliver at the output an atomic or molecular jet of elements corresponding to the at least partial neutralization of the primary ions, a target which intercepts the emergent molecular jet from the charge-exchange box and is of such geometry that the atomic or molecular jet undergoes multiple reflections from the target, said target being intended to contain the compound from which it is desired to produce the highmass ion beam and finally a chamber which is brought to a positive potential opposite to that of the polarity of the secondary ions produced and which surrounds said target.

The primary beam which is at least partially neutralized detaches ions from the target when it bombards the surface of this latter, said ions being extracted from the target by means of an extraction potential applied to the chamber which surrounds said target.

The determining advantage which arises from the use of a molecular (or atomic) jet which is neutral or at least partially neutralized lies in the elimination of the space charge phenomenon which takes place when the target is bombarded with an ion beam such as, for example, in conventional methods of cathodic sputtering. The existence of this space charge prevents the ions of the primary beam from reaching the surface of the target with a high flux, thus resulting in a concomitant reduction of the intensity of the secondary ion flux of high mass emitted by said target in accordance with the invention.

The primary beam employed is thus either composed of neutral particles or of a mixed beam of neutral particles and ions with a proportion of ions which can be variable according to the nature of the substance.

In a preferred alternative embodiment of the invention, a grid brought to a negative potential is placed in the vicinity of the target, thus making it possible to accelerate and orient the ions towards the outlet of the chamber in which the target is placed.

The charge-exchange box in which neutralization of the primary ion beam takes place is of a conventional type as described, for example, in the work by M. Devienne: "Jets moléculaires de hautes et moyennes énergies" (Molécular jets of high and medium energies) (published by Laboratoire de Physique Moléculaire des Hautes Energies 06 —Peymeinade — France, 1972).

Should it be desired to remove the primary ions as these latter pass out of the charge-exchange box, provision is advantageously made for primary ion deflecting plates consisting of electrodes brought to a potential such as to collect or deflect the primary ions to a sufficient extent to ensure that these latter do not reach the target, the neutral particles constituting the molecular jet or beam being unmodified by the presence of these deflecting plates.

In ion sources of the type above described, the beams of neutral particles which arrive on the target produce molecular sputtering of the atoms or molecules of the target, only part of these latter being converted to ions. The greater part of the beam of neutral particles is reflected from the target without being subsequently employed and its energy is thus lost.

In order to obtain ion sources of maximum intensity, especially sources of ions of uranium oxide $UO_2^+$, it is an advantage to ensure that the beam of neutral particles which impinges on the target is utilized with the maximum degree of efficiency.

To this end, the structural design of the source and of the chamber containing said source is such that the jet of neutral particles undergoes multiple reflections from the target in order to improve the conversion efficiency of said ion source by increasing the number of impacts. In other words, the geometrical configuration of the target is such that the atomic jet undergoes multiple reflections from said target before being extracted from the chamber which contains said target. In an illustrative embodiment of the invention, the target has a substantially cylindrical structure and can accordingly constitute an internal lining of the chamber. The generator-lines of said cylindrical chamber are substantially perpendicular to the direction of the primary jet and the normal to the wall of the target on which the initial impact of the primary jet takes place is inclined with respect to the direction of said primary jet at an angle $\theta$ of the order of 60°, for example.

In accordance with one mode of execution of this illustrative embodiment of the ion source in accordance with the invention, that portion of the target on which the initial impact of the primary jet of neutral particles takes place is constituted by two walls forming a dihedron, the edge of which is perpendicular to the generator-lines of the cylinder. In order to ensure that the ions produced as a result of impact of the molecular or atomic jet of netural particles on the target are extracted more effectively, it is an advantage in accordance with the invention to place an electrode having a negative potential with respect to the target in the vicinity of the exit of the beam of secondary ions produced by impact of the primary neutral-particle jet on the target.

It is readily apparent that the geometrical structure of the source contained in the chamber can be varied with a view to obtaining multiple reflections and can have, for example, the shape of a torus or of a cone frustum which is open at both ends.

Further characteristic features and advantages of the invention will become more readily apparent from the following description of examples of construction which are given by way of explanation without any limitation being implied, reference being made to the accompanying drawings, wherein:

FIG. 2 is a general diagrammatic representation of an illustrative form of construction of the ion source in accordance with the invention, in which the incident primary beam undergoes successive multiple relfections;

FIG. 3 is a diagrammatic sectional view of a particular form of target limited by two concentric circular cylinders;

FIG. 4 illustrates another possible form of target having a structure in the shape of a cone frustum.

Figure 1:
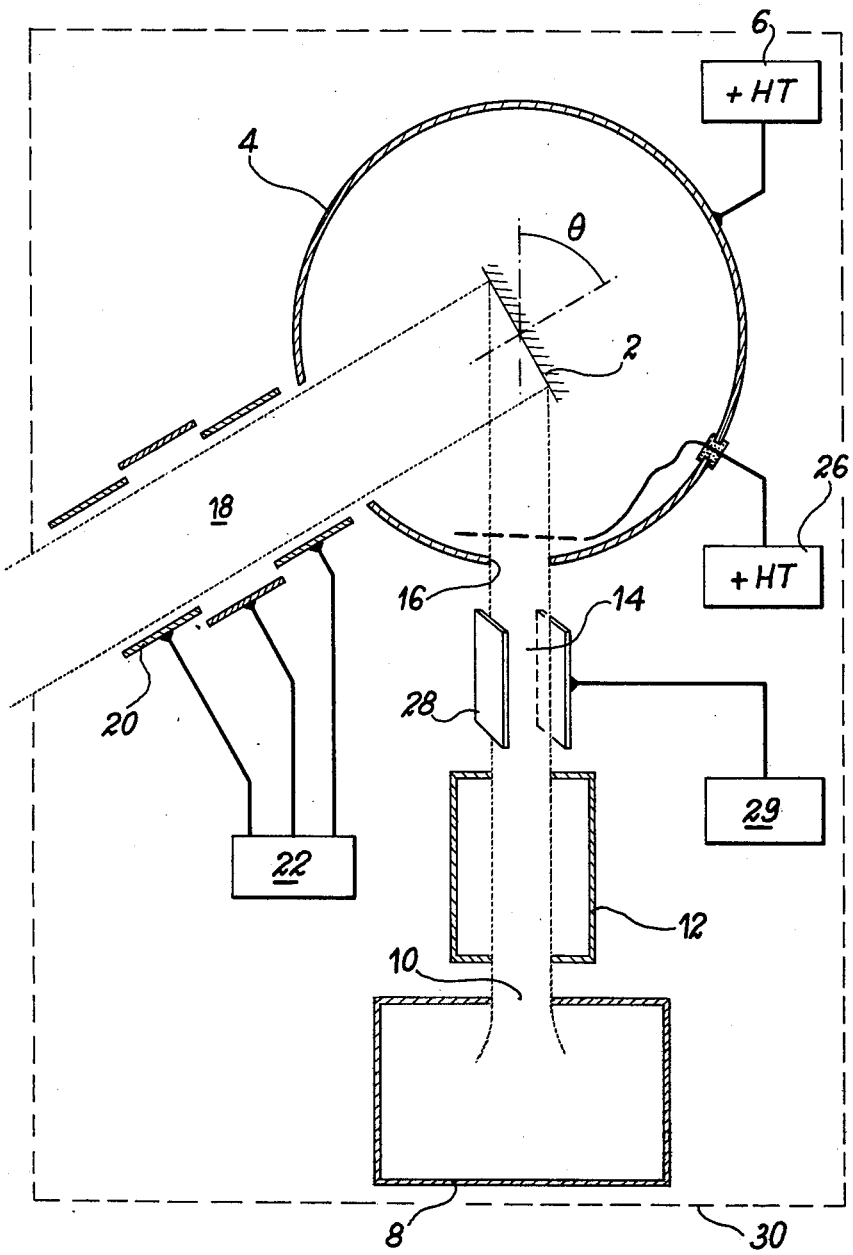
FIG. 1 is a general diagrammatic representation of a form of construction of the ion source without the multiple target reflection feature of the invention.

In FIG. 1 which shows, for background explanation construction of an ion source without the multiple reflection feature of the invention the invention, the target 2 is formed of uranium oxide $UO_2$, for example. The target 2 is surrounded by a chamber 4 of cylindrical shape which is brought to a high voltage by means of a supply 6. The primary ion source 8 of known type is for example a source of high-frequency primary ions which delivers a beam of charged ions (argon, for example) into a charge-exchange box indicated schematically at 12. The constructional detail of said charge-exchange box is not illustrated since this type of box is well known to those versed in the art. At the exit of the charge-exchange box, the primary beam 14 is at least partially neutralized and impinges on the target 2 at an angle $\theta$ after passing through an opening 16 of the chamber 4. Under the action of this atomic (or molecular) jet, ions are detached from the target and produce the desired secondary jet shown at 18. In order to modify the focusing of said jet, use can be made of the focusing lenses such as 20 which are fed from a supply 22.

In FIG. 1, a grid 24 is placed at the entrance of the enclosure 4 and brought, by means of a high-voltage source 26 to a potential slightly above or below that of the enclosure 4, according to the polarity of the ions, in order to prevent exit of ions by the entrance provided for the molecular or atomic beam.

The removal of residual primary ions after passage through the charge-exchange box is carried out by means of deflecting plates 28 if this should prove necessary. In this example of construction, the chamber 4 of cylindrical shape is brought to a potential which is higher than 5000 V. The angle $\theta$ is 60°, the beam 18 being emitted substantially at right angles to the target 2. By way of example, the molecular beam 14 is composed of argon (or of any other neutral substance having a sufficient mass and a kinetic energy within the range of 5000 to 15,000 eV).

Depending on the conditions of impingement of the primary atomic beam on the target 2, the secondary ionic emission ratio obtained can be in the vicinity of unity or even higher.

In this example of construction, the target 2 has been bombarded by a beam of argon corresponding to 5 mA of ions per $cm^2$ having an energy in the vicinity of 5 keV (particle energy of the argon atoms of the beam 14). Under these conditions and by means of the device shown in FIG. 1, it has been possible to obtain intensities of the order of several $mA/cm^2$ in the case of the ionized uranium oxide beam 18. The cylindrical chamber 4 employed has a diameter of 8 cm whilst the molecular beam 14 has a diameter between 5 and 30 mm. The entire device is placed within an enclosure as indicated diagrammatically at 30 in which a suitable vacuum has been produced in order to prevent unwanted phenomena of collision of beams with the gases contained in the surrounding atmosphere.

The intensity of the ion beam emitted by the target 2 depends on the radius of the chamber 4, on the arrangement of the target 2 and of course on the target itself, the physical and chemical characteristics of which are of considerable importance in regard to the intensity of the beam 18, namely in particular the secondary ionic emission ratio of the target and also the bombardment energy.

When negative ions are obtained as a result of molecular bombardment of the target, it is then necessary to bring the chamber 4 to a negative potential.

There is shown in FIG. 2 an illustrative embodiment of the present invention, namely a source of the multiple reflection type, this source being essentially constituted by a chamber 4 which is at least partially lined with a layer of target compound such as uranium oxide $UO_2$, for example.

In FIG. 2, the target chamber has a cylindrical structure with a square directrix and has the shape of a rectangular parallelepiped. The source which produces the beam of neutral particles $F_1$ is identical with the source of the example shown in FIG. 1 and it is not considered necessary to make any further description of said source or of the enclosure 30. The beam $F_1$ is a beam of neutral atoms or molecules which passes into the chamber 4 through the opening 16. That portion of the target which is located opposite to the inlet 16 is constituted by a dihedron 31 formed by two walls having a dihedral angle 2 $\theta$. The incident molecules on one of these walls make an angle $\theta$ with the normal to said wall and are reflected after a first impact along the path 32. At the time of impact of the neutral particles on the target 31 of uranium oxide, uranium ions $UO_2^+$ are emitted and the incident neutral particles are reflected along a re-emission indicatrix shown at 33 so as to be subjected to multiple reflections at the time of their subsequent impacts at 34, 35 and so forth from the walls of the chamber 4. The ions of oxide $UO_2$ which are emitted at each impact are discharged through the lower portion of the chamber 4 along paths such as 36 and 37 shown in chain-dotted lines in FIG. 2.

The chamber 4 can be made up of two portions, namely an upper portion and a lower portion; the upper portion which is shown in cross-section in FIG. 1 has substantially the same structure and the same dimensions as the lower portion.

In a preferred form of construction of this illustrative embodiment of the invention the ions produced at the time of the initial impact on the target opposite to the chamber opening are prevented from escaping through this opening by placing in the vicinity of this latter a grid 38 which is brought to a positive potential with respect to the target chamber 4, thus having the effect of forcing back into the chamber 4 the ions which are produced. Similarly, in order to facilitate extraction of the ions formed as a result of impact of the beam of neutral particles on the target, an electrode 39 is advantageously placed in the vicinity of the exit, for example the lower exit of the target chamber. Said electrode 39 is brought to a negative potential with respect to the target chamber 4, said chamber being in turn brought to a positive potential by the supply 6.

The multiple-reflection source shown in FIG. 2 makes it possible to convert the neutral particle beam $F_1$ to a beam $F_2$ of ions at the exit, for example ions of uranium oxide $UO_2^+$, with a high multiplication factor which can in some cases attain approximately ten: this means that ten uranium oxide ions are formed in the case of each incident primary molecule or atom which reaches the target. The number n of multiple reflections is usually within the range of 3 to 20. The surface of the target chamber 4 is brought to a potential of over 5000 volts for example by means of the supply 6. The potential of the electrode 38 in the form of a grid is over 5100 volts, for example. In order to obtain enhanced efficiency of the source in accordance with the invention, it is an advantage to ensure that the interior of said source is polished with precision in order to obtain a surface having an excellent finish. By employing a molecular or atomic beam (consisting of argon, for example) which strikes a target formed of certain uranium compounds and has an energy of the order of 7000 eV, there is thus obtained an efficiency which is higher than five: one ion of the primary source makes it possible to obtain five ions of the uranium compound.

There is shown by way of alternative in FIG. 3 a geometrical construction of the target chamber 4 in accordance with the invention. The chamber which is shown in cross-section is constituted by two coaxial cylinders 40 and 41, the section plane of FIG. 3 being perpendicular to the axis of the two cylinders. The beam $F_1$ of neutral particles is reflected from the walls 40 and 41 so as to follow a path such as 42 and produces at each reflection ions which escape through the end portion 43 of the chamber 4 in the beam $F_2$.

FIG. 4 shows a target chamber of frusto-conical shape in which the beam $F_1$ of neutral particles is admitted through the large opening of the target chamber 4 and emerges through the small opening 44.

It is readily apparent that the source shown in FIG. 3 and also the source shown in FIG. 4 can include if necessary the different grids and voltage supply shown in FIG. 2. Furthermore, other geometrical designs are possible in the case of the target chamber 4 such as a toric structure, for example, the lining of the torus being constituted by uranium oxide or a uranium metal compound as in the other chambers.

What I claim is:

1. A source of ions of high mass and of intensity not less than 10 mA, especially of ions of uranium oxide $UO_2$, wherein said source comprises, within an evacuated chamber:

a source of primary ions, a charge-exchange box which is fed at the inlet by said source of primary ions and delivers at the outlet a primary molecular or atomic beam which is at least partially neutralized, a target of material to be ionized which intercepts the emergent primary beam from the change-exchange box, an enclosure enclosing space in the immediate vicinity of said target and surrounding at least a volume of space in front of the surfaces of said target exposed to said primary beam, said enclosure being provided with means for bringing said enclosure to a potential relative to ground which corresponds in polarity to that of the ions produced by interception of said primary beam by said target, said enclosure having two apertures, a first aperture disposed so as to permit entry of said primary beam of interception thereof by said target and a second aperture disposed so as to allow exit of a high intensity jet of ions of high mass produced by impact of said primary beam on said target, said target having a geometrical configuration such that the primary molecular or atomic beam which produces ions by sputtering when intercepted by said target undergoes multiple reflections from said target and consequently makes a number of impacts producing secondary ions of high mass before all of said ions of high mass are extracted from said enclosure.

2. An ion source according to claim 1, wherein the target constitutes the lining of a portion of said enclosure, the assembly constituted by said enclosure and associated target being such as to have a substantially toric shape and structure, and wherein the normal to the wall of the target on which the first impact of the primary beam takes place is inclined at an acute angle ($\theta$) with respect to the direction of said primary beam.

3. An ion source according to claim 1, wherein the target constitutes the lining of said enclosure, said enclosure having a substantially frustoconical shape and being disposed with respect to said primary beam so that said primary beam is parallel to the axis of said enclosure and is reflected at least twice by the internal frustoconical targets lining of said enclosure.

4. An ion source according to claim 1, wherein said source further comprises plates for deflecting the primary ions mixed with said molecular beam at the exit of the charge-exchange box.

5. An ion source according to claim 1, wherein the primary molecular (or atomic) beam at the exit of the charge-exchange box makes an angle of approximately 60° with the normal to the surface of said target on which said primary beam is initially incident.

6. An ion source according to claim 1, wherein said source further comprises focusing lenses placed on each side of the beam of ions of high mass at the exit of said chamber.

7. An ion source according to claim 1, wherein the target constitutes the lining of a portion of said enclosure, the assembly constituted by said enclosure and said associated target being such as to have substantially tubular shape, said tubular shape being generated by parallel generator-lines substantially perpendicular to the direction of the primary beam and wherein the normal to the wall of the target on which the first impact of the primary beam takes place is inclined at an acute angle $\theta$ with respect to the direction of said primary beam.

8. An ion source according to claim 7, wherein that portion of the target on which the first impact of the primary beam takes place is constituted by the lining of two walls of said enclosure deviating from the said substantially tubular shape and forming a dihedron having an edge at right angles to said generator-lines of said tubular shape.

9. An ion source according to claim 7, wherein the target enclosure is bounded by two concentric circular cylinders.

10. An ion source according to claim 1, wherein the target is brought to a positive potential of the order of several thousand volts.

11. An ion source according to claim 1, wherein a grid is placed in front of the opening of the enclosure containing the target and is brought to a positive potential with respect to said target.

12. An ion source according to claim 1, wherein said source further comprises one or a number of electrodes brought to a negative potential with respect to the target and placed in the vicinity of the exit of the beam of ions of high mass which emerges from the chamber.

13. An ion source according to claim 7, wherein said generator-lines generate said substantially tubular shape with respect to a directrix which is a square, whereby said substantially tubular shape is the shape of a square tube.

14. An ion source according to claim 7, wherein said generator-lines generate said substantially tubular shape with respect to a directrix which is a circle, whereby said substantially tubular shape is a circular cylinder.

* * * * *

UNITED STATES PATENT AND TRADEMARK OFFICE

CERTIFICATE OF CORRECTION

PATENT NO. : 4,145,629

DATED : March 20, 1979

INVENTOR(S) : FERNAND MARCEL DEVIENNE

It is certified that error appears in the above-identified patent and that said Letters Patent are hereby corrected as shown below:

Column 3, line 11,
"for background explanation" should be
--for background explanation, a--.

Column 5 , claim 1; line 51:
"change-exchange" should be --charge-exchange--.

Column 5, claim 1, line 62:
"primary beam of interception" should be
--primary beam for interception--.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*